US010113281B2

(12) United States Patent
Gilpatrick et al.

(10) Patent No.: US 10,113,281 B2
(45) **Date of Patent: *Oct. 30, 2018**

(54) SNOWTHROWER IMPELLER ASSEMBLY WITH RIGID CUTTING IMPLEMENT

(71) Applicant: Briggs & Stratton Corporation, Wauwatosa, WI (US)

(72) Inventors: Richard J. Gilpatrick, Whitewater, WI (US); John E. Gulke, Fond du Lac, WI (US); Peter Jerger, Cedarburg, WI (US); Christopher M. Fisher, Island Lake, IL (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,315

(22) Filed: Nov. 21, 2017

(65) Prior Publication Data

US 2018/0094395 A1 Apr. 5, 2018

Related U.S. Application Data

(63) Continuation of application No. 15/092,321, filed on Apr. 6, 2016, now Pat. No. 9,840,818, which is a continuation of application No. 14/190,956, filed on Feb. 26, 2014, now Pat. No. 9,309,638.

(60) Provisional application No. 61/923,136, filed on Jan. 2, 2014, provisional application No. 61/770,084, filed on Feb. 27, 2013.

(51) Int. Cl.

| | |
|---|---|
| ***E01H 5/04*** | (2006.01) |
| ***E01H 5/09*** | (2006.01) |
| *E01H 5/12* | (2006.01) |

(52) U.S. Cl.
CPC ..... *E01H 5/045* (2013.01); *E01H 5/098* (2013.01); *E01H 5/12* (2013.01)

(58) Field of Classification Search
CPC ..... E01H 5/045; E01H 5/098; E01H 5/12
See application file for complete search history.

(56) References Cited

U.S. PATENT DOCUMENTS

| | | | | |
|---|---|---|---|---|
| 2,723,470 A * | 11/1955 | Harnack | E01H 5/09 | 37/238 |
| 2,735,199 A | 2/1956 | Wanner et al. | | |
| 2,910,819 A * | 11/1959 | Helliwell | A01D 57/04 | 56/220 |
| 3,321,851 A * | 5/1967 | Fisher | E01H 1/045 | 37/209 |
| 3,429,061 A * | 2/1969 | Haban | E01H 5/098 | 37/258 |
| 3,452,460 A | 7/1969 | Cope et al. | | |

(Continued)

*Primary Examiner* — Jamie L McGowan
(74) *Attorney, Agent, or Firm* — Foley & Lardner LLP

(57) ABSTRACT

An impeller assembly for a snowthrower includes a driven shaft configured to rotate about an axis, a flexible impeller configured to rotate about the axis and extending horizontally across substantially a complete width of the impeller assembly parallel to the axis, and a rigid cutting implement. The flexible impeller extends radially from the driven shaft to an impeller radial distance. The rigid cutting implement extends radially from the driven shaft to a cutting implement radial distance less than the impeller radial distance, wherein the rigid cutting implement is spaced apart from and does not contact the flexible impeller.

20 Claims, 16 Drawing Sheets

(56) References Cited

U.S. PATENT DOCUMENTS 3,525,002 A 8/1970 Mattson et al.
3,673,715 A * 7/1972 Lines ..... E01H 1/056 37/195
3,774,321 A 11/1973 David
3,775,878 A * 12/1973 Beckner ..... A01D 42/08 37/233
3,805,421 A 4/1974 Kamlukin et al.
4,203,237 A * 5/1980 Enters ..... E01H 5/04 198/659
4,322,896 A * 4/1982 Miyazawa ..... E01H 5/04 37/233
4,360,983 A 11/1982 Krug
4,397,088 A * 8/1983 Hampel ..... A01D 34/90 285/419
4,833,800 A 5/1989 Ting
4,908,968 A 3/1990 Thorud et al.
4,951,403 A 8/1990 Olmr
RE33,726 E 10/1991 Thorud et al.
5,101,585 A * 4/1992 Gerbrandt ..... E01H 5/04 37/249
5,398,431 A 3/1995 Beihoffer et al.
5,758,436 A 6/1998 Harms
6,327,798 B1 12/2001 Sakai et al.
6,470,602 B2 * 10/2002 White, III ..... E01H 5/062 37/244
6,860,041 B2 * 3/2005 Sakai ..... E01H 5/098 37/250
6,865,826 B1 3/2005 Lakin
6,922,921 B2 8/2005 Sakai et al.
D519,127 S 4/2006 Shaffer et al.
7,257,909 B2 * 8/2007 Shaffer ..... E01H 1/056 37/232
7,314,096 B2 1/2008 Shaffer et al.
7,320,192 B2 * 1/2008 Algren ..... A01D 51/007 37/256
7,412,786 B1 * 8/2008 Stewart ..... E01H 5/04 37/233
7,472,500 B2 1/2009 White, III
D675,232 S 1/2013 Martin et al.
9,663,909 B2 * 5/2017 Mast ..... E01H 5/098
2002/0020083 A1 2/2002 White et al.
2004/0139631 A1 * 7/2004 Hanafusa ..... E01H 5/045 37/242
2004/0172861 A1 * 9/2004 Sakai ..... E01H 5/04 37/242
2006/0096136 A1 5/2006 Shaffer et al.
2013/0074376 A1 * 3/2013 Hishida ..... E01H 5/098 37/252

* cited by examiner

SNOWTHROWER IMPELLER ASSEMBLY WITH RIGID CUTTING IMPLEMENT

CROSS-REFERENCE TO RELATED PATENT APPLICATIONS

This application is a continuation of U.S. application Ser. No. 15/092,321, filed Apr. 6, 2016, which is a continuation of U.S. application Ser. No. 14/190,956, filed Feb. 26, 2014, which claims priority to and the benefit of U.S. Application No. 61/770,084, filed Feb. 27, 2013, and U.S. Application No. 61/923,136, filed Jan. 2, 2014, all of which are incorporated herein by reference in their entireties.

BACKGROUND

The use of snowthrowers (or snowblowers) by both commercial and residential operators is common for those located in snowy winter climates. Snowthrowers may be walk-behind units or may be propelled by other machinery (e.g., all-terrain vehicles, tractors, etc.). Typically, snowthrowers are divided into two categories: single-stage snowthrowers and multi-stage snowthrowers. Single-stage snowthrowers generally incorporate an impeller assembly that is driven by an internal combustion engine (or similar prime mover, such as an electric motor) to perform the functions of propelling the snowthrower forward, lifting snow from the surface to be cleared, and ejecting the snow out of a discharge chute. A multi-stage snowthrower includes a separate auger assembly and impeller assembly. Both the auger assembly and impeller assembly are driven by an internal combustion engine (or similar prime mover). The auger assembly rotates near the surface to be cleared in order to lift and direct snow and debris to the impeller assembly, which rotates along an axis perpendicular to the axis of rotation of the auger assembly. The impeller assembly then acts to eject snow out of a discharge chute.

In single-stage snowthrowers, the impeller assembly is generally formed of a flexible material which contacts the surface to be cleared as it is directed along a path by the user. Due to this direct contact with the surface, single-stage snowthrowers typically clear the entire surface of snow quite well. However, because the impeller assembly performs the tasks of propelling the snowthrower, lifting the snow, and ejecting the snow from the discharge chute, there are limitations to the size, shape, and material of the impeller assembly. These limitations reduce the effectiveness of the impeller assembly of a single-stage snowthrower in deep, icy, and/or heavy snow conditions.

On the other hand, multi-stage snowthrowers are generally more adept at clearing deep and/or heavy snow than their single-stage counterparts. This is because the auger assembly of multi-stage snowthrowers is typically formed of a rigid material (e.g., metal) that both separates and lifts the snow to be cleared and delivers it to the impeller assembly for ejection from the discharge chute. However, as the auger assembly is formed as a rigid component, the auger assembly is generally positioned within an auger housing so as to be a certain distance above the surface to be cleared. While in some ways it is advantageous for the rigid auger assembly to not contact the surface to be cleared, there is also the potential disadvantage of some snow being left behind and/or compacted as the snowthrower passes. Additionally, multi-stage snowthrowers are generally much larger, heavier, and more costly than single-stage snowthrowers.

Referring to FIG. 1 and FIG. 2, a conventional impeller and impeller housing assembly for a single-stage snowthrower is shown. While not illustrated, one of ordinary skill in the art would readily recognize that the impeller assembly 100 could be rotatably driven by any suitable prime mover (e.g., an internal combustion engine or electric motor). Assembly 100 includes an impeller 102 coupled to a driven shaft 104 which rotates about axis A within impeller housing 106. Impeller 102 operates to propel collected snow out of a discharge chute (not shown) of the snowthrower via flexible paddles 108*a*, 108*b*. Paddles 108*a*, 108*b* may be formed of any suitable flexible material, e.g. rubber. Each paddle 108*a*, 108*b* is coupled to driven shaft 104 via a central mounting plate 110 and respective side mounting plates 112*a*, 112*b*. As impeller assembly 100 rotates about axis A, paddles 108*a*, 108*b* contact the surface to be cleared of snow to not only lift and propel the snow out of a discharge chute, but also to propel the snowthrower in a forward direction of travel. However, as discussed above, due to the flexible nature and orientation of paddles 108*a*, 108*b*, icy or heavy snow is not readily broken down by impeller assembly 100, which may cause substantial clogging within the impeller housing and/or discharge chute.

SUMMARY

One embodiment of the invention relates to an impeller assembly for a snowthrower including a driven shaft configured to rotate about an axis, a flexible impeller configured to rotate about the axis and extending horizontally across substantially a complete width of the impeller assembly parallel to an axis, and a rigid cutting implement. The flexible impeller extends radially from the drive shaft to an impeller radial distance, and the rigid cutting implement extends radially from the driven shaft to a cutting implement radial distance less than the impeller radial distance. The cutting implement is spaced apart from and does not contact the flexible impeller.

Another embodiment of the invention relates to impeller assembly for a snowthrower including a flexible impeller configured to rotate about an axis, where the flexible impeller extends radially from the axis to an impeller radial distance, and a cutting implement extends radially from the axis to a distal end at a cutting implement radial distance less than the impeller radial distance. The distal end of the cutting implement is spaced apart from and does not contact the flexible impeller.

Another embodiment of the invention relates to a impeller assembly for a snowthrower including an impeller paddle configured for rotation about an axis, where the impeller paddle extends radially from the axis to a paddle radial distance, and a tine extending radially from the axis to a distal end at a tine radial distance less than the paddle radial distance. The distal end of the tine is spaced apart from and does not contact the flexible impeller.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings.

DETAILED DESCRIPTION OF THE PREFERRED EMBODIMENTS

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
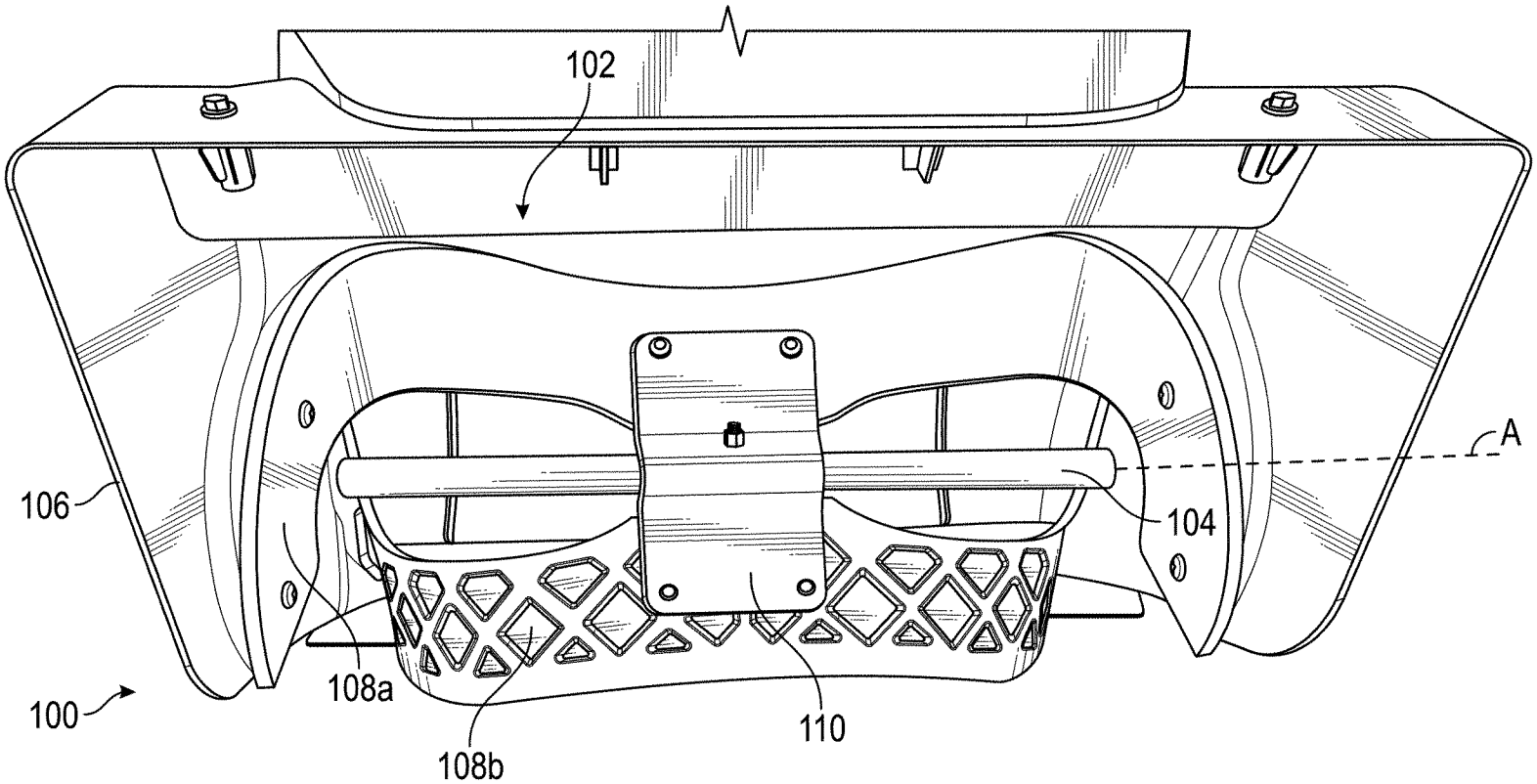
FIG. 1 (Prior Art)
FIG. 1 illustrates a front view of a conventional single-stage snowthrower impeller assembly.
Figure 2:
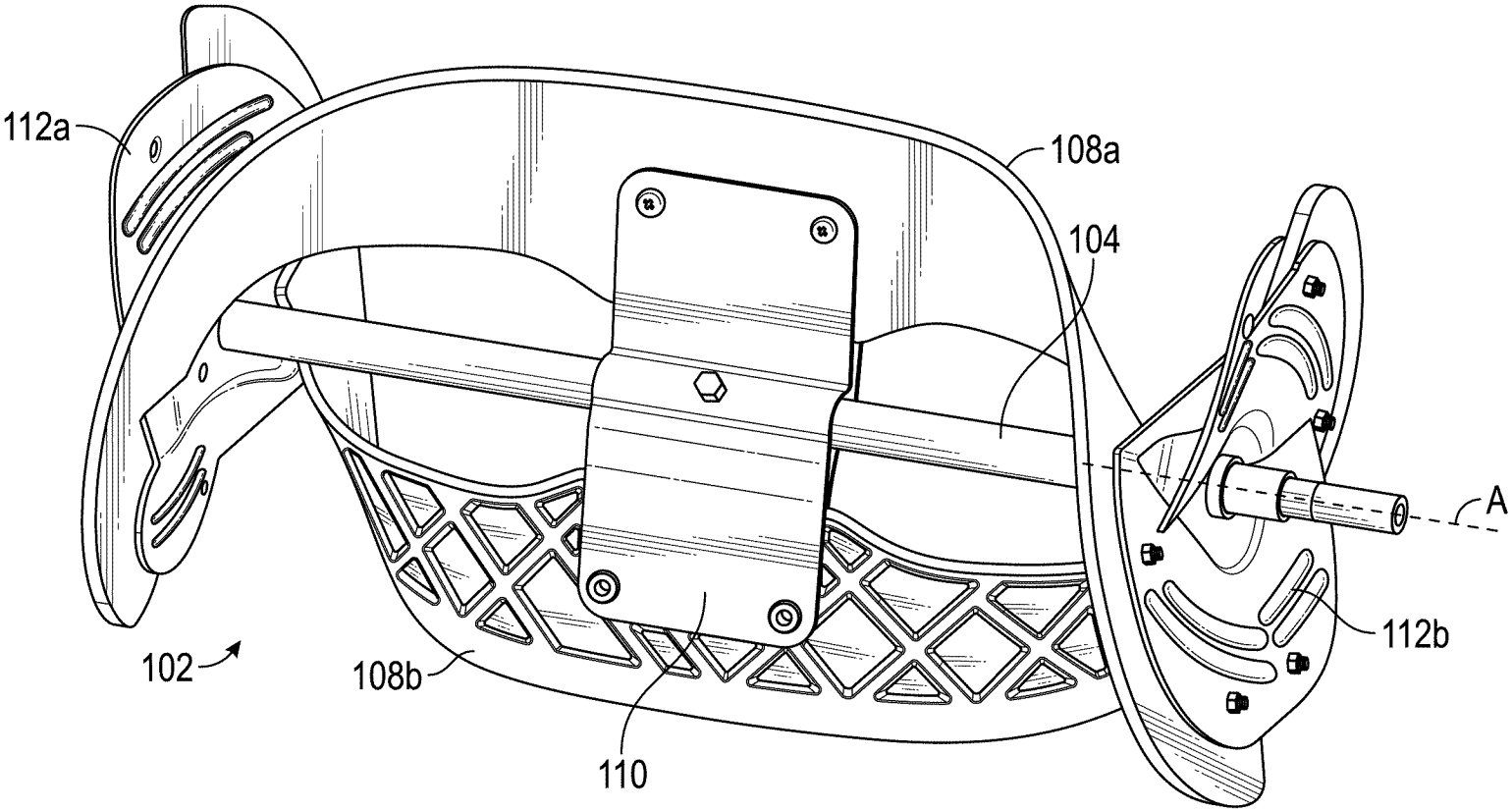
FIG. 2 (Prior Art)
FIG. 2 illustrates a perspective view of a conventional single-stage snowthrower impeller assembly.
Figure 3:
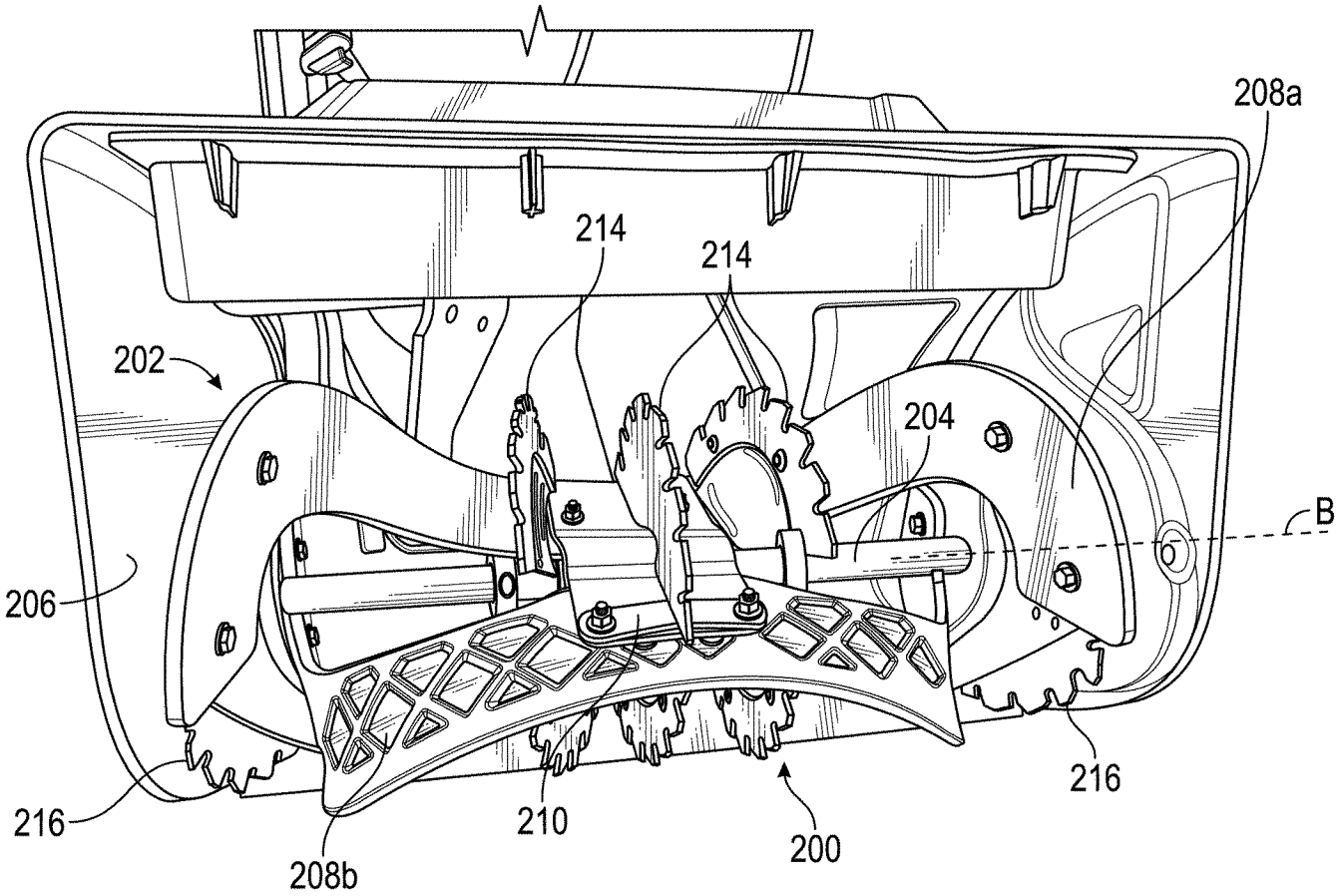
FIG. 3 illustrates a front view of a single-stage snowthrower impeller assembly with ice chopping blades in accordance with an exemplary embodiment.
Figure 4:
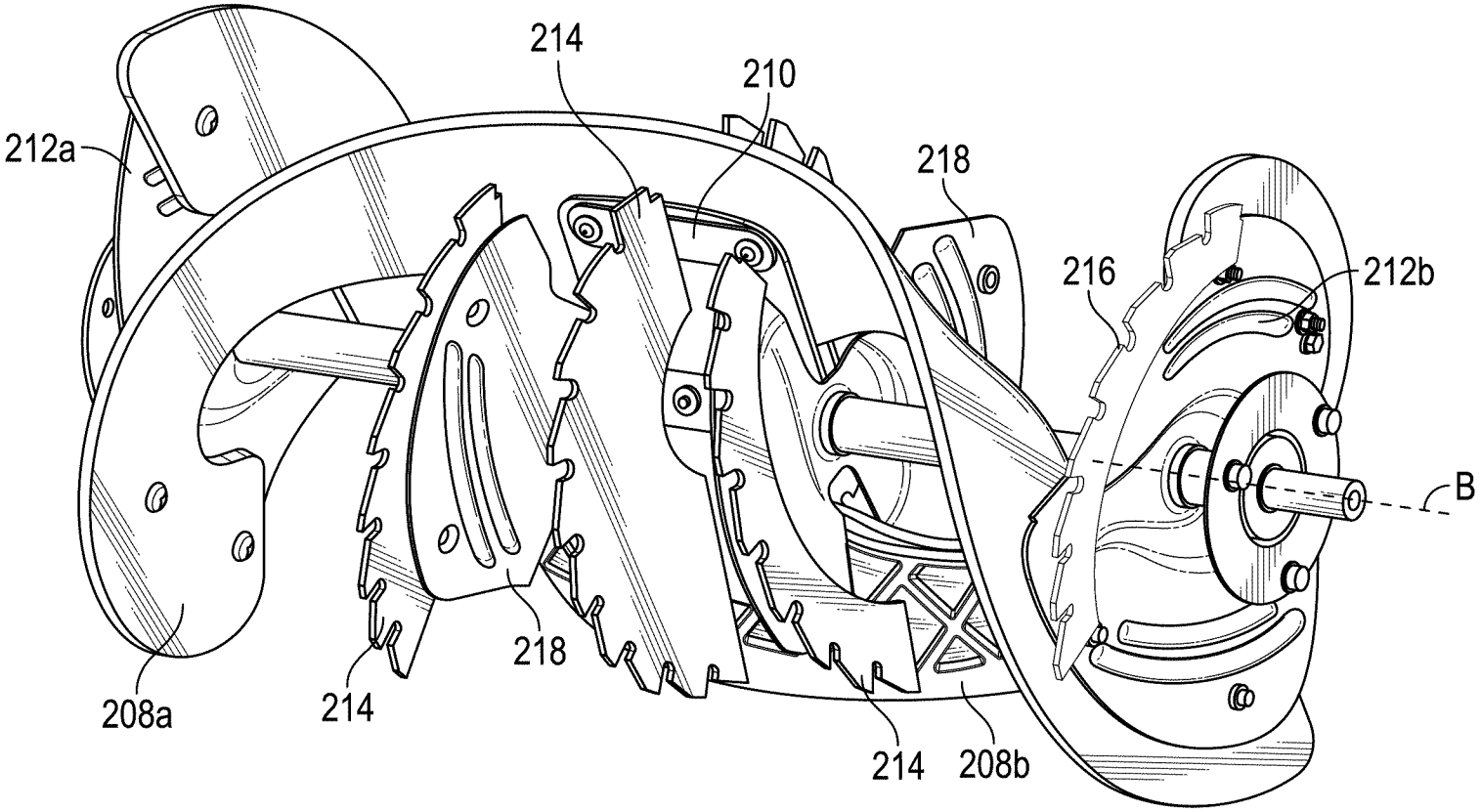
FIG. 4 illustrates a perspective view of the single-stage snowthrower impeller assembly of FIG. 3.

Referring to FIGS. 3 and 4, an impeller and an impeller housing assembly in accordance with an exemplary embodiment are shown. The impeller assembly 200 may be driven by any suitable prime mover (e.g., an internal combustion engine or electric motor). Assembly 200 includes an impeller 202 coupled to a driven shaft 204 which rotates about axis B within impeller housing 206. Impeller 202 operates to propel collected snow out of a discharge chute (not shown) of the snowthrower via flexible paddles 208*a*, 208*b*. Paddles 208*a*, 208*b* may be formed of any suitable flexible material, e.g. rubber. Each paddle 208*a*, 208*b* is coupled to driven shaft 204 via a central mounting plate 210 and respective side mounting plates 212*a*, 212*b*. Central mounting plate 210 is mounted to a central portion of the driven shaft 204 (i.e., at or near the center point of the driven shaft) between the side mounting plates 212*a*, 212*b*. As impeller 202 rotates about axis B, paddles 208*a*, 208*b* contact the surface to be cleared of snow to not only lift and propel the snow out of a discharge chute, but also to propel the snowthrower in a forward direction of travel. In some embodiments, paddles 208*a*, 208*b* are positioned between and attached to a pair of central mounting plates 210 ("sandwiched" between two mounting plates).

Impeller assembly 200 further includes one or more rigid cutting implements in the form of central ice chopping blades 214 and a plurality of side ice chopping blades 216. Rigid cutting implements are capable of cutting, chopping, slicing, or otherwise breaking up snow or ice located on top of a surface to be cleaned. Ice chopping blades 214, 216 are shown as serrated, saw-like blades in FIG. 3 and FIG. 4, but any implement or blade shape capable of chopping/cutting through heavy snow and ice may be suitable. One or more central ice chopping blades 214 may be coupled directly to central mounting plate 210, while side ice chopping blades 216 may be coupled to side mounting plates 212*a*, 212*b*. One or more additional central ice chopping blades 214 may be mounted on dedicated blade mounting plates 218, which are in turn coupled to driven shaft 204. It is also possible for all ice chopping blades 214, 216 to be mounted to their own dedicated mounting plates or to be mounted directly to existing central mounting plate 210 and side mounting plates 212*a*, 212*b*. Additionally, blades 214, 216 may be replaceable and removably mountable on respective mounting plates or may be integrally formed as a single blade/mounting plate unit.

As impeller assembly 200 rotates about axis B at a relatively high speed (e.g., 1100 rpm), not only do paddles 208*a*, 208*b* contact the surface to be cleared of snow lift and propel the snow out of a discharge chute, but ice chopping blades 214, 216 also rotate to break up heavy snow and ice encountered in the path of travel, allowing that snow to more easily be lifted and propelled out of the discharge chute. Both central ice chopping blades 214 and side ice chopping blades 216 may be angled such that any broken up snow or ice is delivered to paddles 208*a*, 208*b* for efficient discharge. Also, because central ice chopping blades 214 and side ice chopping blades 216 do not contact and are not mounted directly on flexible paddles 208*a*, 208*b*, the benefits of having a flexible, ground-contacting paddle to lift and clear snow is not impaired by a rigid blade or other rigid member attached thereto.

Figure 5:
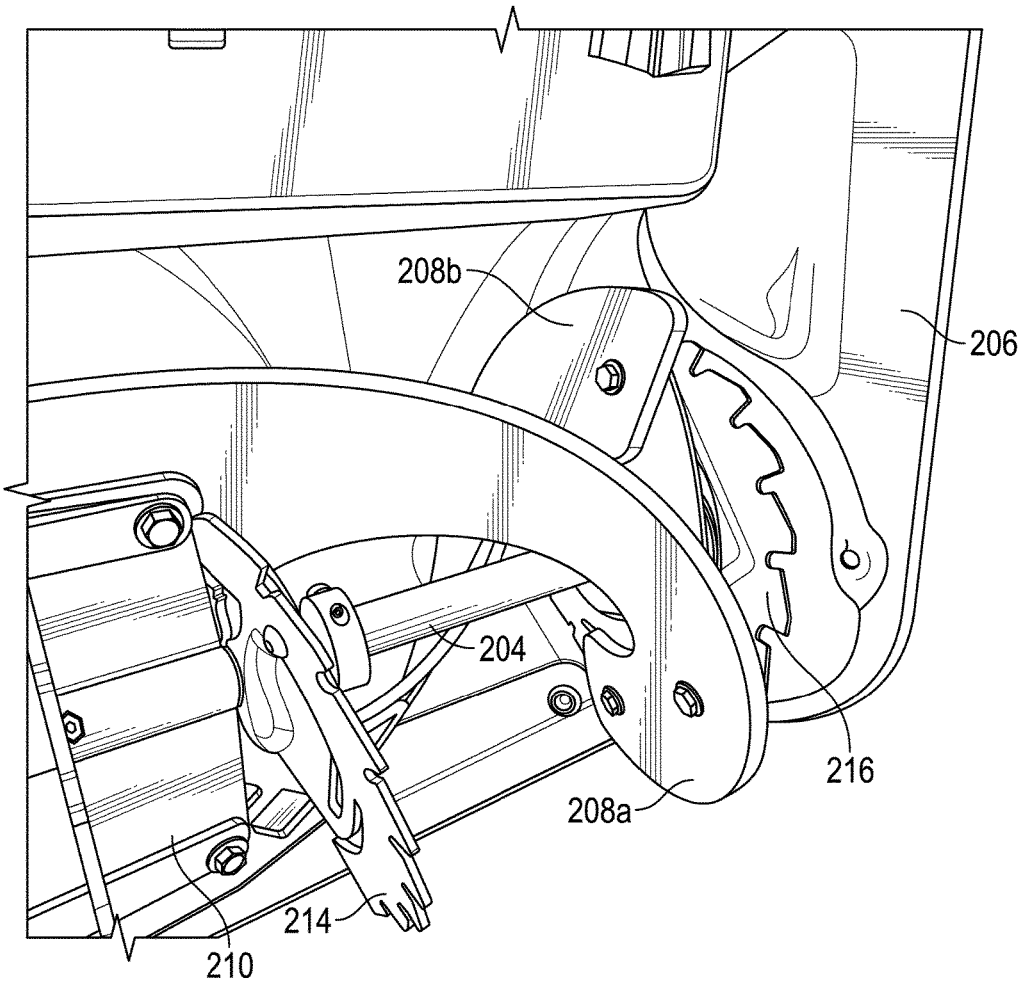
FIG. 5 illustrates a perspective view of a first end of the single-stage snowthrower impeller assembly of FIG. 3.
Figure 6:
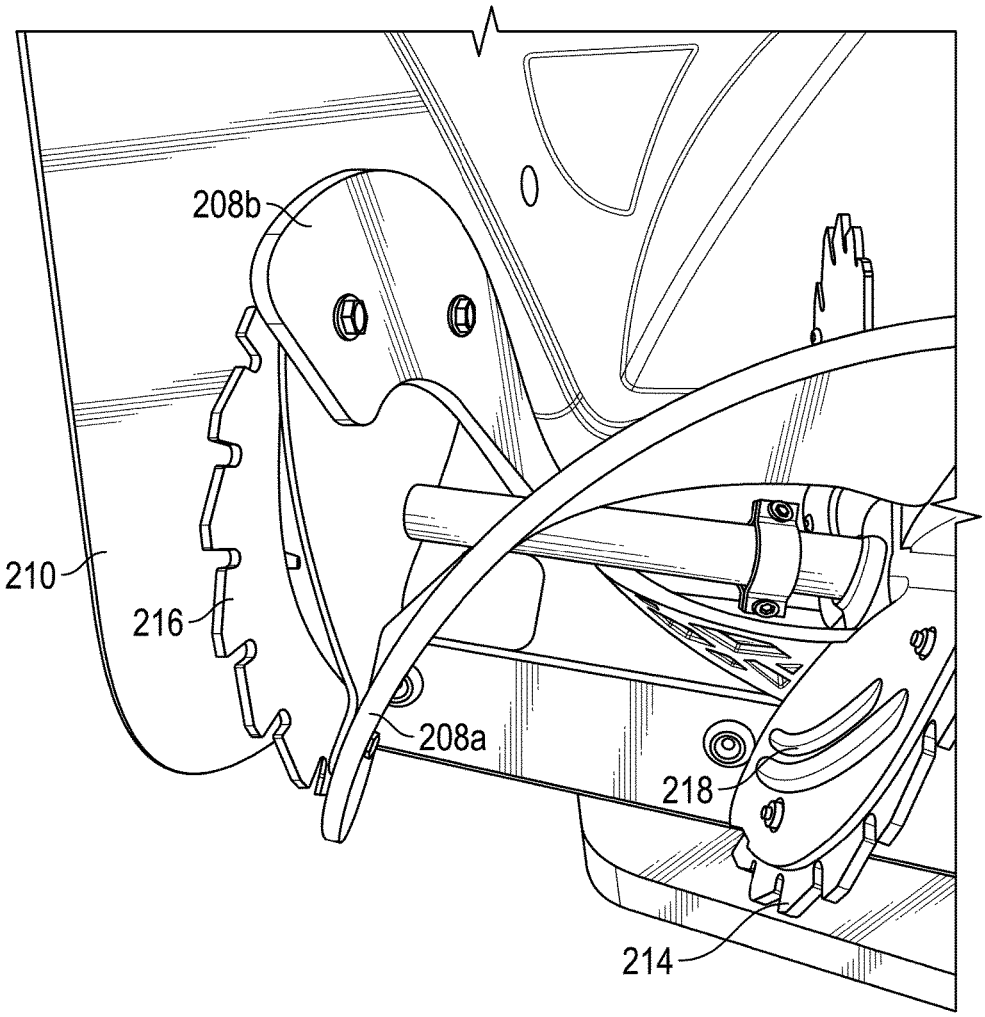
FIG. 6 illustrates a perspective view of a second end of the single-stage snowthrower impeller assembly of FIG. 3.

FIG. 5 and FIG. 6 are perspective views of the respective right and left sides of impeller assembly 200. Side ice chopping blades 216 act to break up ice or heavy snow that enters impeller housing 206 at or near the respective ends of impeller 202, while central ice chopping blades 214 act to break up ice or heavy snow entering housing 206 near the center. FIG. 5 and FIG. 6 further illustrate how central ice chopping blades 214 may be angled relative to axis B to better break up ice or snow and direct those broken-up portions to impeller 202 and out of the discharge chute.

Figure 7:
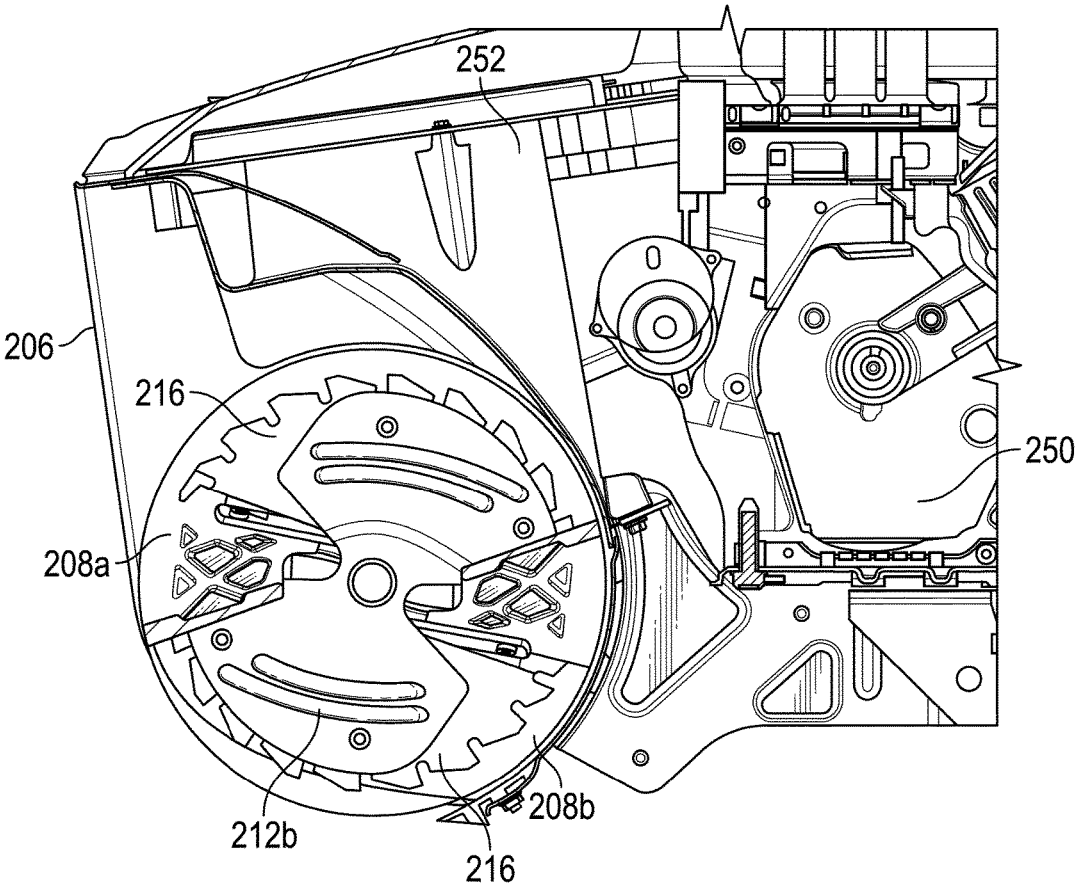
FIG. 7 illustrates a sectional side view of the first end of the single-stage snowthrower impeller assembly of FIG. 3.

FIG. 7 illustrates a sectional side view of the snowthrower and impeller assembly 200 with ice chopping blades 216. Impeller housing 206 is situated in front of and slightly below an internal combustion engine 250 that is mounted on a frame. Impeller housing 206 contains side mounting plate 212*b*, upon which is mounted side ice shopping blades 216. Impeller paddles 208*a*, 208*b* are also mounted to side mounting plate 212*b*. As impeller paddles 208*a*, 208*b* rotate, snow and ice is collected within impeller housing 206 and propelled out of a discharge chute 252, thereby removing the snow and ice from the surface to be cleared. While not shown, it is to be understood that a sectional view of the opposite side of the impeller assembly would show a similar configuration.

Figure 8:
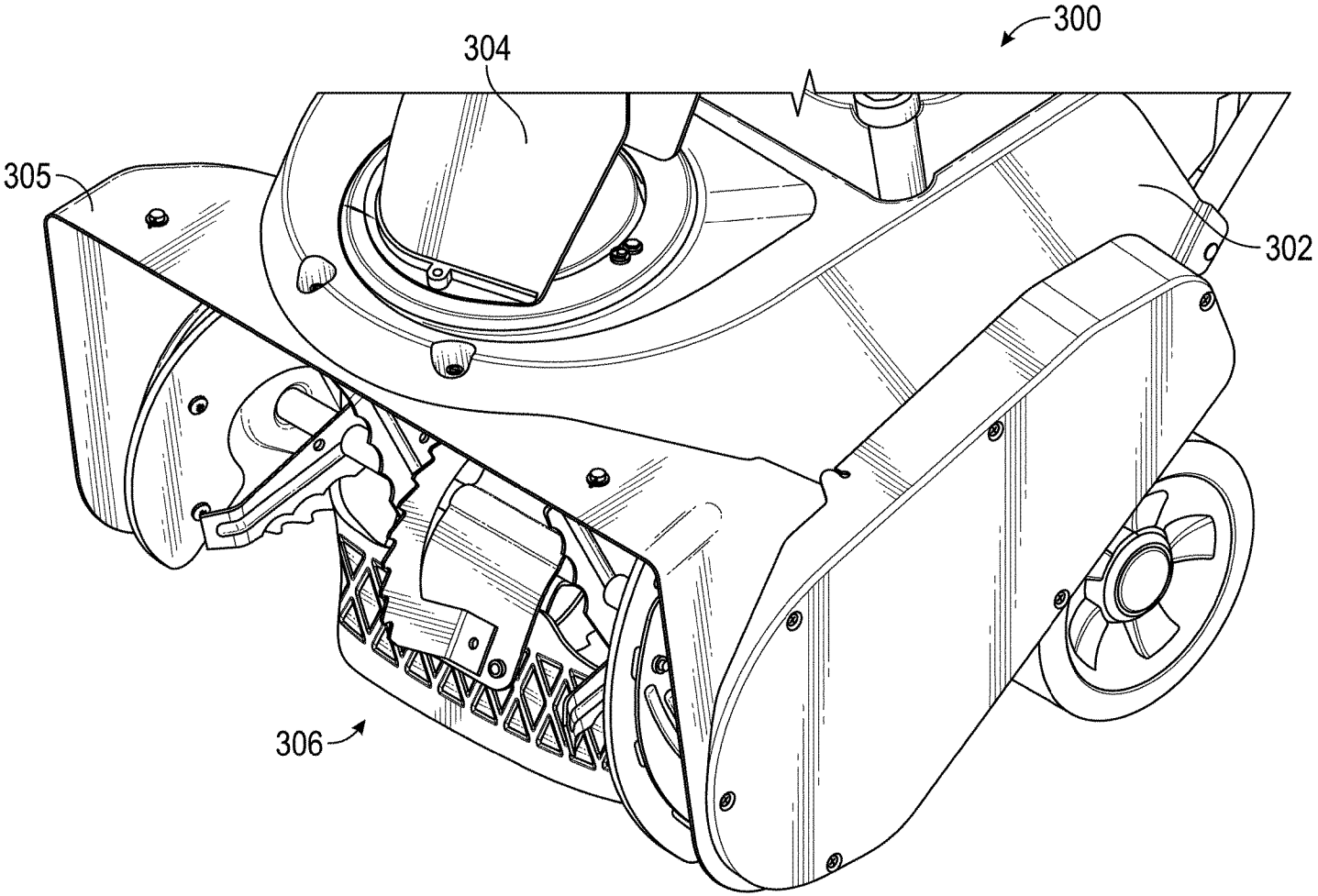
FIG. 8 illustrates a perspective view of a snowthrower including an impeller assembly with ice chopping blades in accordance with an exemplary embodiment.

Referring to FIG. 8, a partial perspective view of a snowthrower and impeller assembly with ice chopping blades in accordance with an exemplary embodiment is shown. Snowthrower 300 comprises a base housing 302 on which a discharge chute 304 is mounted. The discharge chute 304 is rotatably coupled to the base housing 302 so that the direction of snow discharge from the chute 304 can be controlled. While not shown in FIG. 8, snowthrower 300 further comprises an internal combustion engine or other prime mover, wherein the internal combustion engine or other prime mover is operably coupled to an impeller assembly 306 to rotate impeller assembly 306 in order to both lift/clear snow from the path of snowthrower 300 and propel snowthrower 300 in a forward direction. Impeller assembly 306 is mounted within an impeller housing 305 and is operably coupled to the engine or other prime mover (e.g., via one or more chains, belts, gears, and/or pulleys housed at least partially within an impeller drive housing). Impeller assembly 306 is itself rotatably mounted within the impeller housing 305, which is coupled to or a component of base housing 302. Snowthower 300 may be a single-stage snowthrower or a multi-stage snowthrower. In some embodiments, impeller assembly 306 may be the sole stage (e.g., impeller, auger, or other moving component for clearing, collecting, gathering, moving snow) of a single-stage snowthrower. In other embodiments, impeller assembly 306 may be one of multiple stages (e.g., impellers, augers, or other moving components for clearing, collecting, gathering, moving snow) of a multi-stage snowthrower. For example, a multistage snowthrower may include impeller assembly 306 as a first stage for clearing snow and/or ice from the surface to be cleared and a second impeller as a second stage for moving the snow and/or ice cleared by impeller assembly 306 to and through discharge chute 304. The second impeller may be driven by the prime mover at a higher speed (i.e., higher rate of rotation) than impeller assembly 306.

Turning now to FIGS. 9-10 and 13-17, additional views of impeller assembly 306 are provided. Impeller assembly 306 comprises a first impeller paddle 312*a* and a second impeller paddle 312*b* coupled to a driven shaft 314 for rotation about an axis of rotation C. Impeller paddles 312*a*, 312*b* are formed of a flexible material like rubber or similar type of pliable-yet-resilient material. As driven shaft 314 rotates, impeller paddles 312*a*, 312*b* are configured to slightly contact the surface to be cleared not only to lift the snow in the path, but also to propel the snowthrower forward.

Impeller assembly 306 further includes one or more rigid cutting implements (e.g., blades, tines, disks, etc.) configured to rotate about driven shaft 314 along with impeller paddles 312*a*, 312*b*. For example, impeller assembly 306 comprises shaped cutting disks 316*a*, 316*b* mounted near each end of driven shaft 314. Cutting disks 316*a*, 316*b* are directly coupled to driven shaft 314 and formed with angles that mimic the curvature of respective impeller paddles 312*a*, 312*b*. Cutting disks 316*a*, 316*b* are preferably formed of a metallic material, but may be formed of any rigid material. Cutting disks 316*a*, 316*b* also each have a pair of serrated sections 318*a*, 318*b* on a portion of their outer perimeter. Serrated sections 318*a*, 318*b* may be integrally formed with the rest of cutting disks 316*a*, 316*b* or may be separate components attached to the rest of cutting disks 316*a*, 316*b*. Cutting disks 316*a*, 316*b* not only aid in lifting snow into discharge chute 304, but also aid in breaking up hard-packed snow or ice that lie in of the path of the snowthrower due to contact between the cutting disks 316*a*, 316*b*, particularly serrated sections 318*a*, 318*b*, and the snow or ice on the surface to be cleared. Cutting disks 316*a*, 316*b* also include mounting points 320 configured to allow impeller paddles 312*a*, 312*b* to be mounted thereto. Mounting points 320 allow cutting disks 316*a*, 316*b* to attach impeller paddles 312*a*, 312*b* to driven shaft 314.

Impeller assembly 306 also comprises a plurality of tines 319*a*, 319*b*, 319*c*, 319*d* that are coupled to driven shaft 314 and interspersed between impeller paddles 312*a*, 312*b*. This coupling could be done by way of any appropriate method, such as welding, bolting, etc. The tines may extend perpendicularly or at an angle from driven shaft 314. Tines 319*a*, 319*b*, 319*c*, 319*d* each have opposing angular sections 322*a*, 322*b* at their distal ends, as well as serrated sections 324*a*, 324*b* on opposing and opposite sides of each tine. As with cutting disks 316*a*, 316*b*, tines 319*a*, 319*b*, 319*c*, 319*d* are preferably formed of a metallic material, but may be formed of any rigid material. As driven shaft 314 rotates, tines 319*a*, 319*b*, 319*c*, 319*d* (and cutting disks 316*a*, 316*b*) act to break up hard-packed snow and ice that is in the path of the snowthrower. Tines 319*a*, 319*b*, 319*c*, 319*d* are spaced apart from and do not contact impeller paddles 312*a*, 312*b*.

Figure 12:
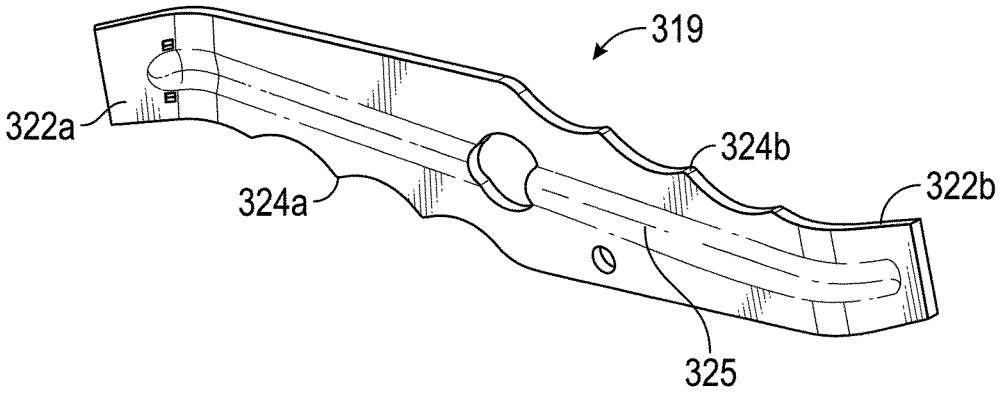
FIG. 12 illustrates another ice chopping blade of the impeller assembly of FIG. 8 in accordance with an exemplary embodiment.
Figure 13:
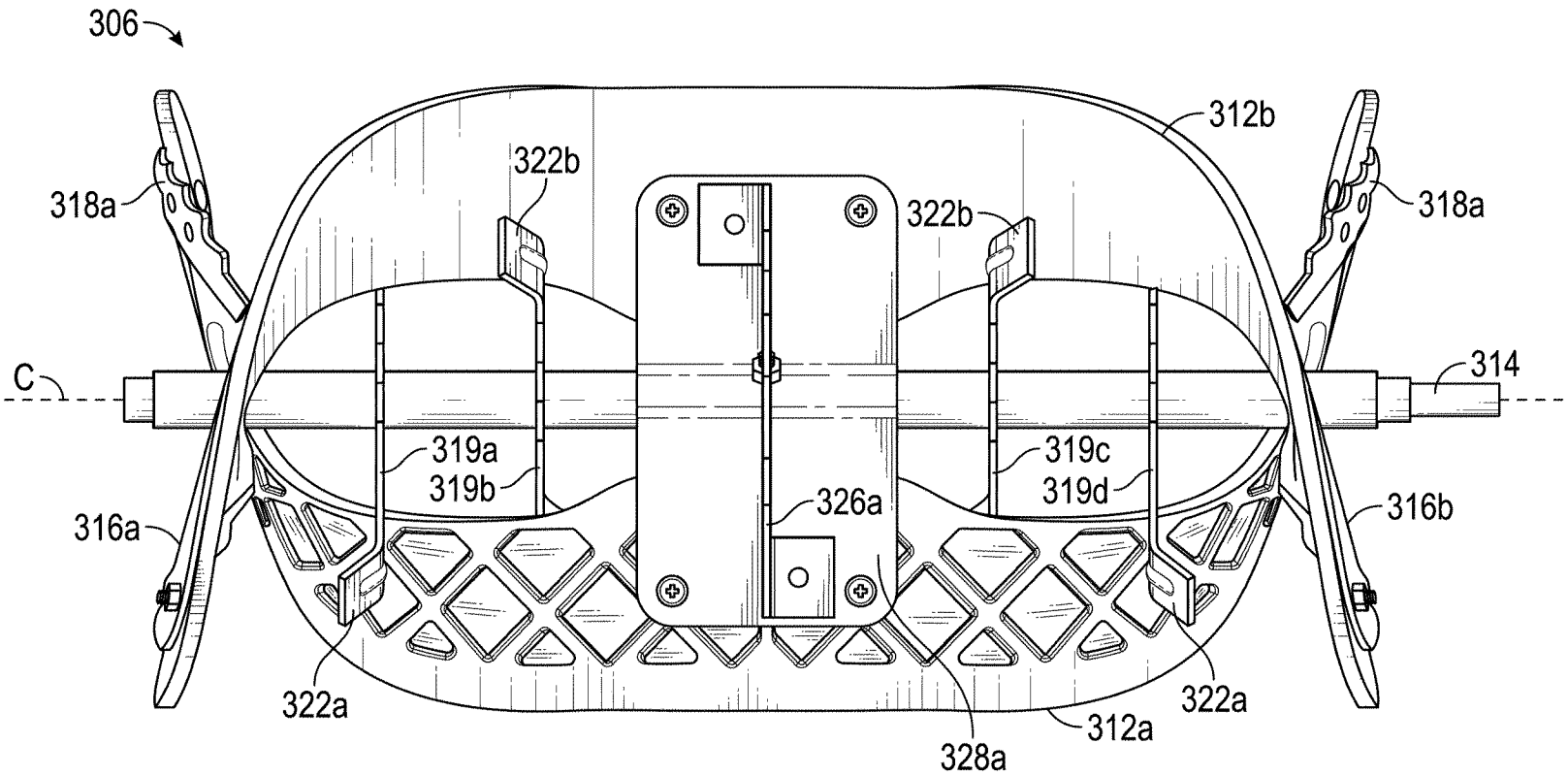
FIG. 13 illustrates a front view of the impeller assembly of FIG. 8.
Figure 14:
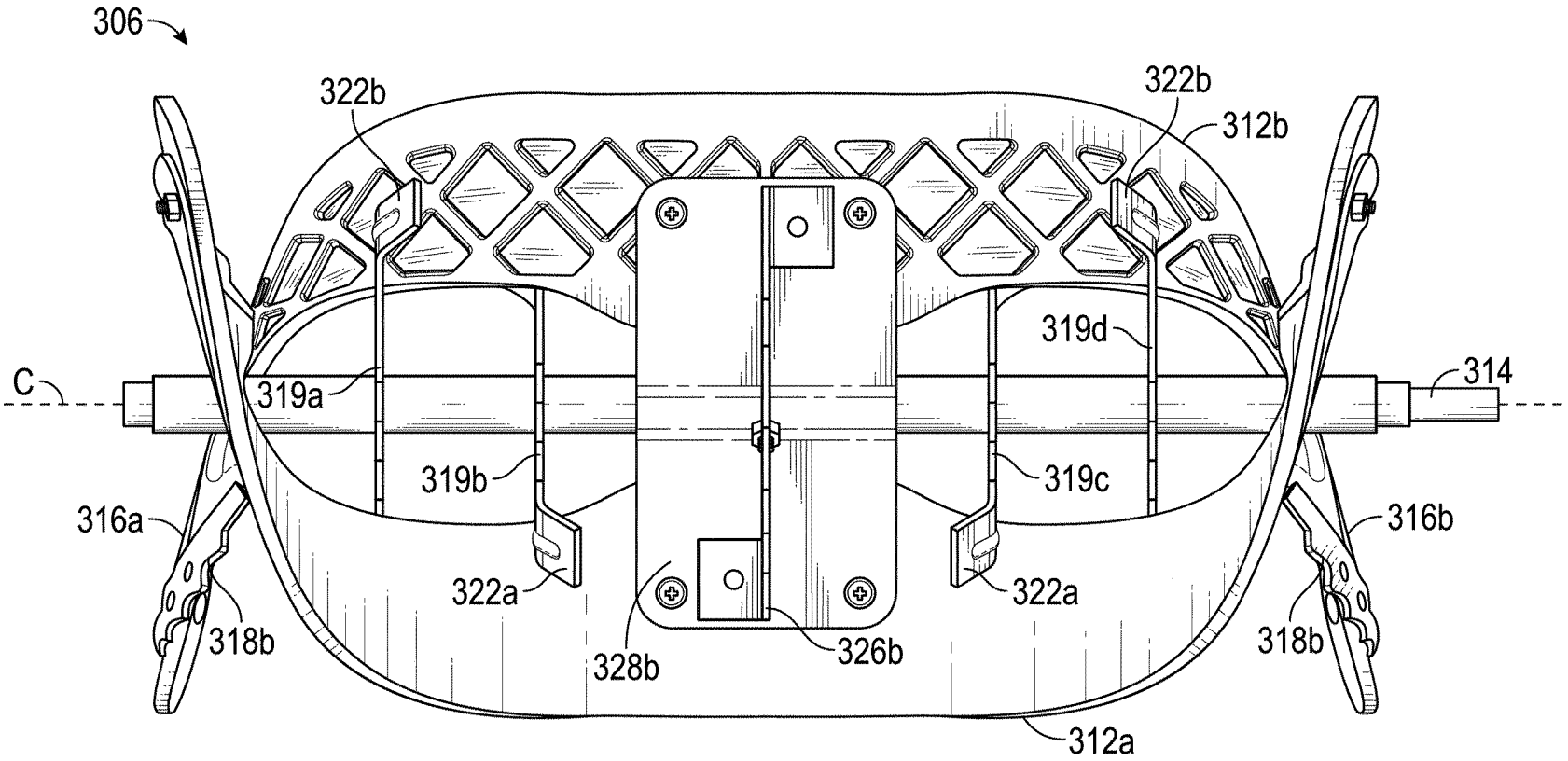
FIG. 14 illustrates a rear view of the impeller assembly of FIG. 8.
Figure 15:
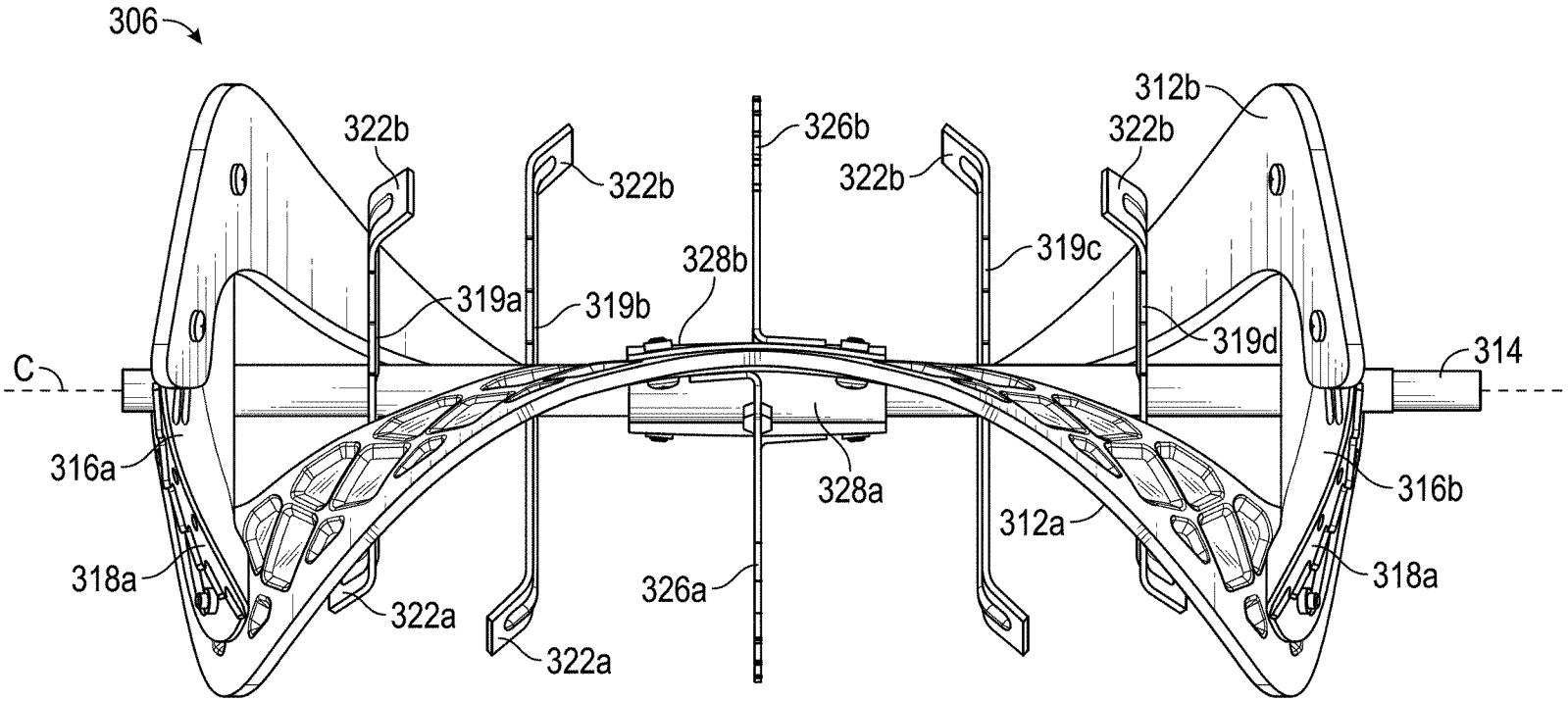
FIG. 15 illustrates a top view of the impeller assembly of FIG. 8.
Figure 16:
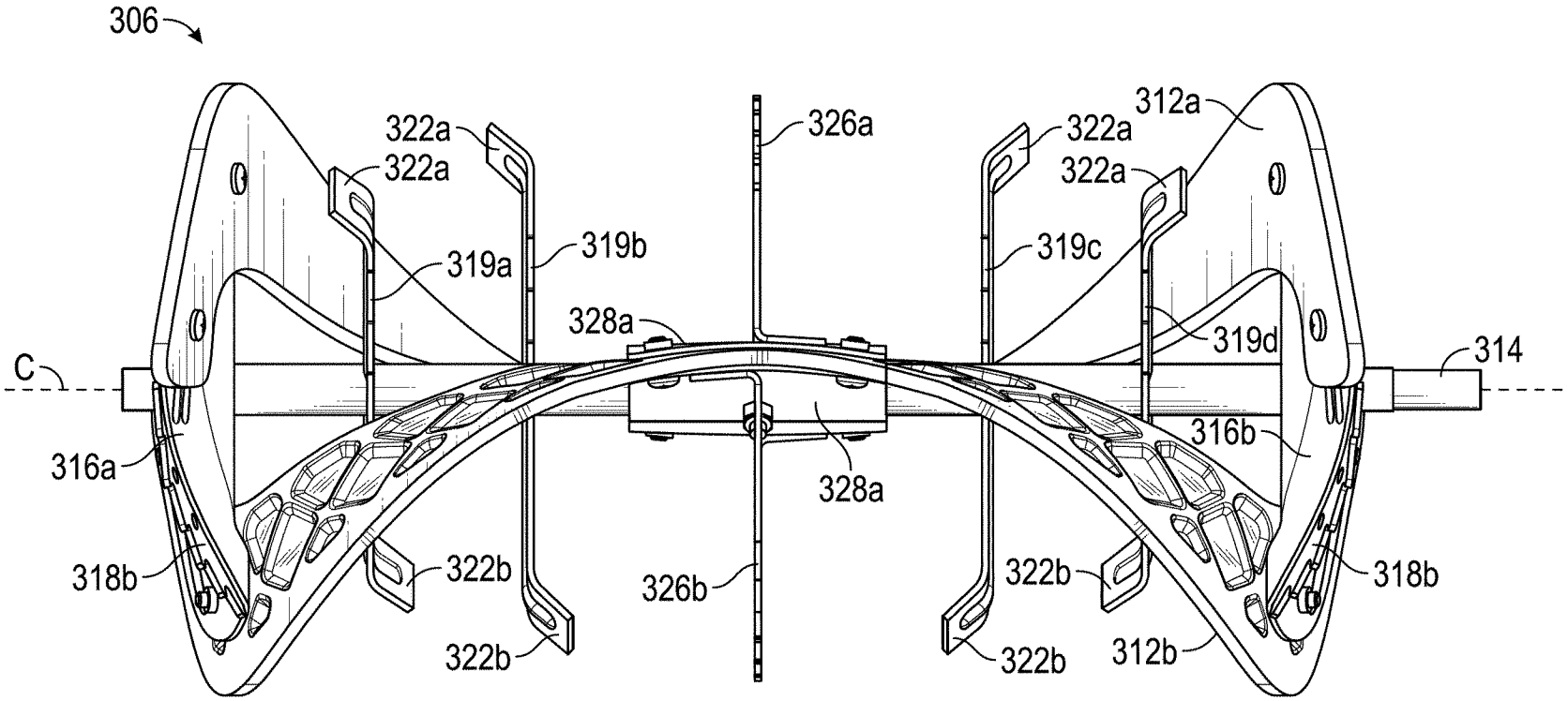
FIG. 16 illustrates a bottom view of the impeller assembly of FIG. 8

Referring to FIG. 12, a more detailed view of a tine 319 in accordance with an exemplary embodiment is shown. Tine 319 includes a first body portion including serrated section 324*a* extending away from the driven shaft in a first direction and a second body portion including serrated section 324*b* extending away from the driven shaft in a second opposite direction. Angled portion 322*a* extends at an angle from the first body portion at the distal end of the first body portion and angled portion 322*b* extends at an angle from the second body portion at the distal end of the second body portion. Tine 319 also comprises a rib 325 running along a substantial portion of its length. Rib 325 gives tine 319 improved overall stiffness and helps prevent tine 319 from bending under high stresses such as contact with heavy snowpack and/or ice. However, rib 325 is not necessary for tine 319 to be effective.

Figure 9:
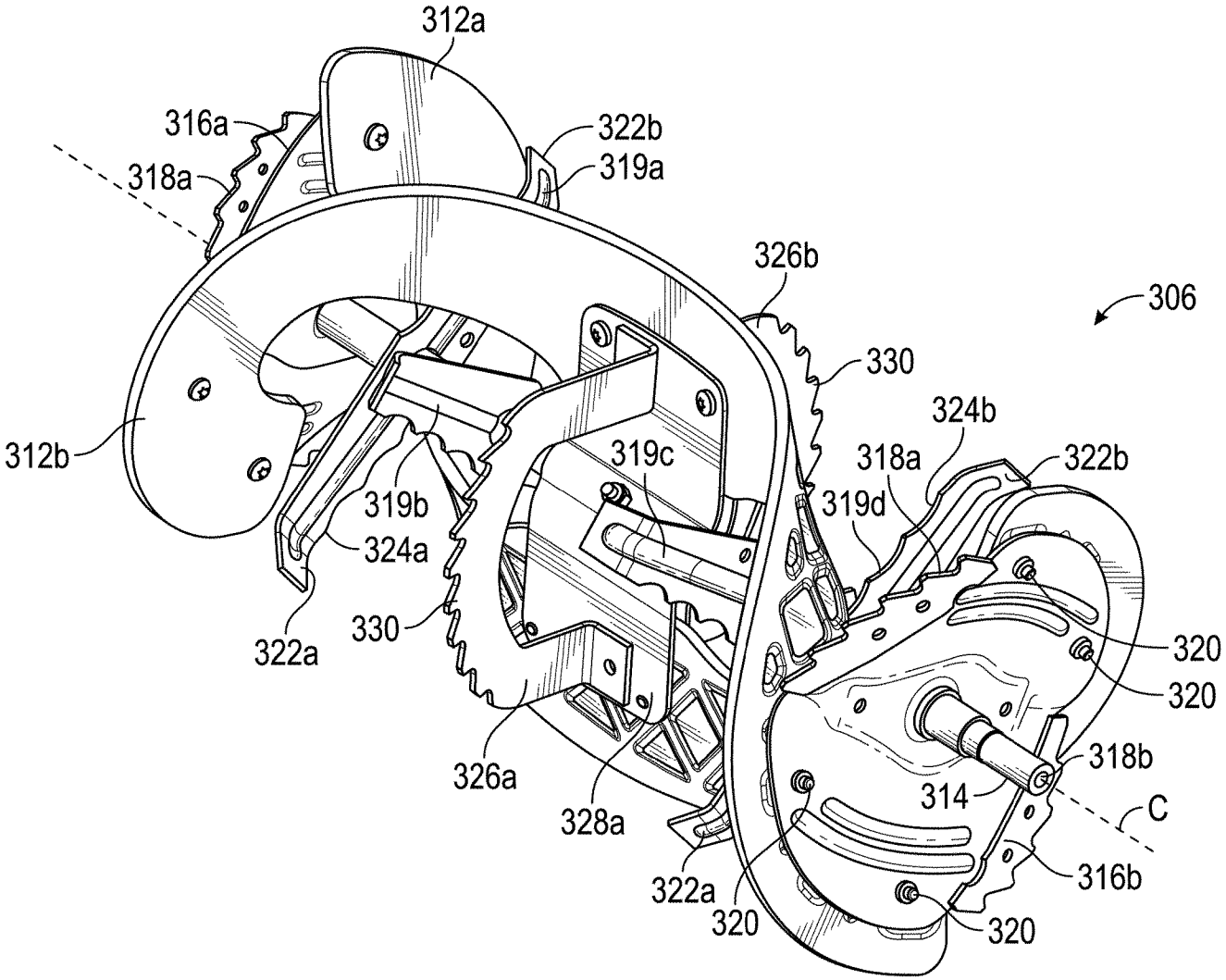
FIG. 9 illustrates a perspective view of the impeller assembly of FIG. 8.
Figure 10:
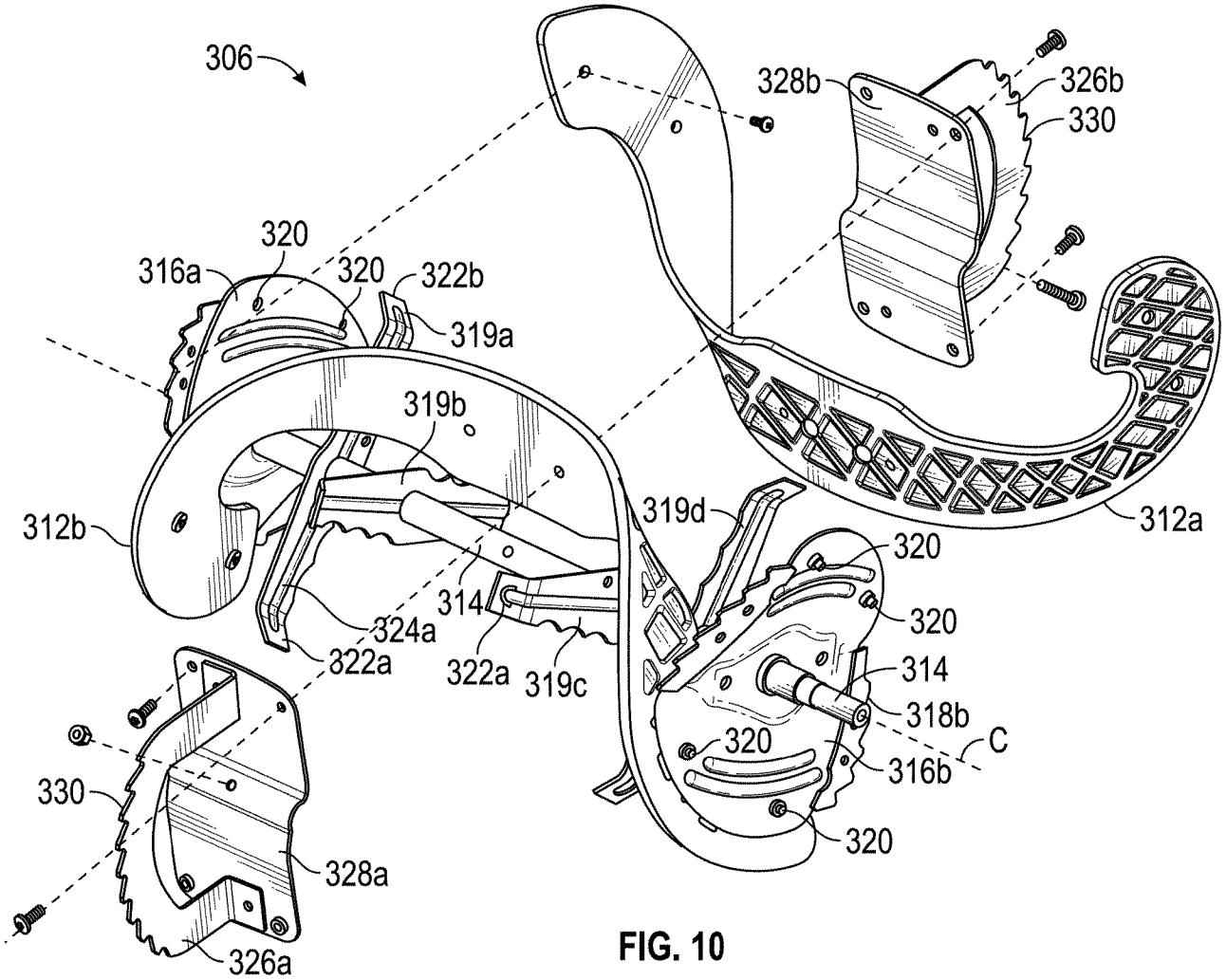
FIG. 10 illustrates an exploded view of the impeller assembly of FIG. 8.
Figure 11:
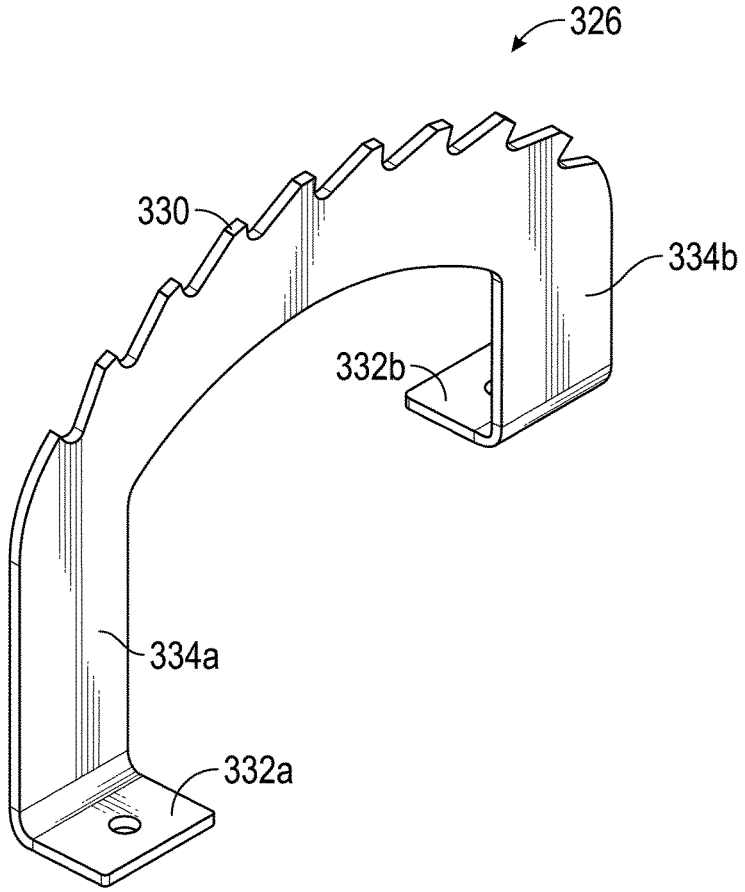
FIG. 11 illustrates an ice chopping blade of the impeller assembly of FIG. 8 in accordance with an exemplary embodiment.

FIGS. 9 and 10 also show a pair of central curved blade members 326*a*, 326*b*. Curved blade members 326*a*, 326*b* are coupled to driven shaft 314 via a pair of respective plates 328*a*, 328*b*, wherein plates 328*a*, 328*b* further comprise mounting points for the coupling of impeller paddles 312*a*, 312*b* to plates 328*a*, 328*b*. Plates 328*a*, 328*b* are mounted to a central portion of the driven shaft 314 (i.e., at or near the center point of the driven shaft) between the cutting disks 316*a*, 316*b*. Curved blade members 326*a*, 326*b* and plates 328*a*, 328*b* are preferably formed of a rigid material, e.g., metal. Each curved blade member 326*a*, 326*b* comprises a serrated section 330 that acts to break up hard-packed snow and ice in the path of impeller assembly 306. Also, the radial distance of curved blade members 326*a*, 326*b* is less than that of impeller paddles 312*a*, 312*b* so as to prevent contact of curved blade members 326*a*, 326*b* with the ground. FIG. 11 shows a more detailed view of one of curved blade members 326. Note that the mounting points 332*a*, 332*b* are opposed relative to one another on the respective arms 334*a*, 334*b* of blade member 326. This configuration adds to the lateral stiffness of blade member 326 when mounted along driven shaft 314 via a plate 328.

Figure 17:
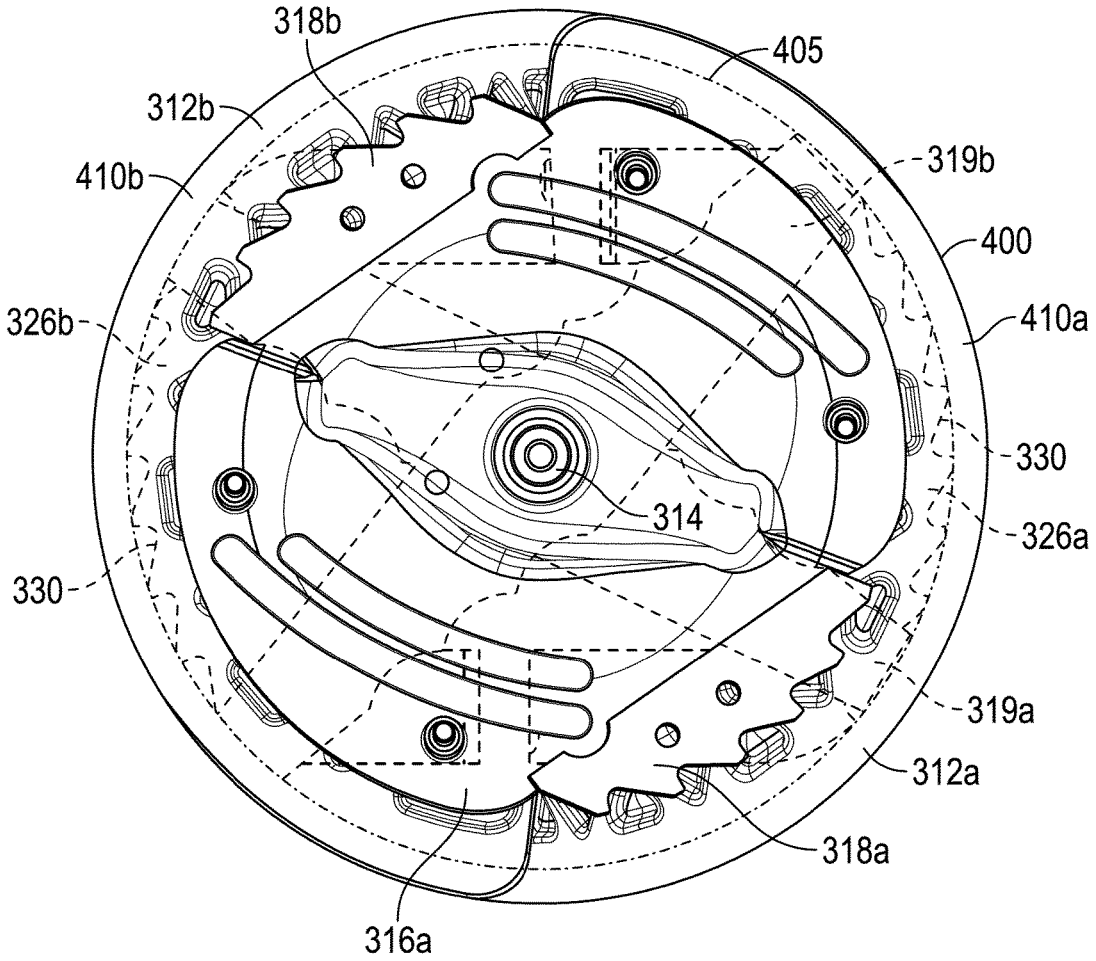
FIG. 17 illustrates a side view of the impeller assembly of FIG. 8.

Referring to FIG. 17, impeller paddles 312*a*, 312*b* extend radially from axis C to a radial distance 400 (i.e., the maximum or outermost radial distance of the paddles from the axis of rotation C of the driven shaft). Cutting disks 316*a*, 316*b*, tines 319*a*, 319*b*, 319*c*, 319*d*, and blade members 326*a*, 326*b* extend radially from axis C to a radial distance 405 (i.e., the maximum or outermost radial distance of the disks, tines, or blade members from the axis of rotation C) less than radial distance 400. This configuration ensures that impeller paddles 312*a*, 312*b* contact the surface to be cleared, while cutting disks 316*a*, 316*b*, tines 319*a*, 319*b*, 319*c*, 319*d*, and blade members 326*a*, 326*b* act to break up snow and ice in the path of impeller assembly 306 without actually contacting the ground. The rigid cutting implements (i.e., cutting disks 316*a*, 316*b*, tines 319*a*, 319*b*, 319*c*, 319*d*, and blade members 326*a*, 326*b*) contact and break up the snow and ice on top of the surface to be cleared (e.g., driveway, sidewalk), but do not contact the surface to be cleared itself. The flexible impeller paddles 312*a*, 312*b* contact the surface to be cleared and are able to flex and clear the surface at least in part because impeller paddles 312*a*, 312*b* extend to a greater radial distance 400 than the rigid cutting implements (distance 405), which allows impeller paddles 312*a*, 312*b* to maintain their flexibility. Overhang portions 410*a*, 410*b* of impeller paddles 312*a*, 312*b* extend from radial distance 405 to radial distance 400 and are able to flex relatively freely because the rigid cutting implements (particularly cutting disks 316*a*, 316*b* and blade members 326*a*, 326*b*) do not contact and stiffen overhang portions 410*a*, 410*b* relative to the remaining portions of impeller paddles 312*a*, 312*b*. Rigid implements extending to the same radial distance as the impeller paddles have been found to negatively impact the flexibility of the impeller paddles, which reduces the ability of the impeller paddles to clear the surface to be cleared. Rigid implements extending to the same radial distance as the impeller paddles cause the impeller assembly to function much more like the rigid auger of a multi-stage snow thrower than a standard flexible impeller of a single-stage snow thrower. The increased rigidity of an impeller assembly including rigid implements extending to the same radial distance as the impeller paddles may lead to the increased build-up of snow and ice within the impeller housing, leading to potential blockages or preventing the impeller assembly 306 from rotating, causing the prime mover to stall.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. An impeller assembly for a snowthrower, comprising:
a driven shaft configured to rotate about an axis;
a flexible impeller extending horizontally across substantially a complete width of the impeller assembly along the axis and configured to rotate about the axis, wherein the flexible impeller extends radially from the driven shaft to an impeller radial distance; and
a rigid cutting implement extending radially from the driven shaft to a cutting implement radial distance less than the impeller radial distance, wherein the rigid cutting implement is spaced apart from and does not contact the flexible impeller.

2. The impeller assembly of claim 1, wherein the flexible impeller comprises a plurality of flexible paddles.

3. The impeller assembly of claim 1, further comprising:
a first side mounting plate attached to a first end of the flexible impeller and a second side mounting plate attached to a second end of the flexible impeller;
wherein the first and second side mounting plates are attached to the driven shaft.

4. The impeller assembly of claim 1, wherein the rigid cutting implement comprises a tine.

5. The impeller assembly of claim 4, wherein the tine includes a first body portion extending away from the axis in a first direction and a second body portion extending away from the axis in a second opposite direction.

6. The impeller assembly of claim 5, wherein the tine further includes a first angled portion extending at an angle from the first body portion at the distal end of the first body portion and a second angled portion extending at an angle from the second body portion at the distal end of the second body portion.

7. The impeller assembly of claim 2, wherein the rigid cutting implement is one of a plurality of cutting implements.

8. The impeller assembly of claim 1, further comprising:
two cutting disks, each cutting disk attached at an end of the flexible impeller to couple the flexible impeller to the driven shaft.

9. The impeller assembly of claim 8, further comprising:
a blade attached by a plate to a central portion of the driven shaft between the two cutting disks and wherein the flexible impeller is attached to the plate.

10. The impeller assembly of claim 1, further comprising:
a blade attached by a plate to a central portion of the driven shaft between the two cutting disks and wherein the flexible impeller is attached to the plate.

11. An impeller assembly for a snowthrower, comprising:
a flexible impeller configured to rotate about an axis and extending horizontally across substantially a complete width of the impeller assembly along the axis, wherein the flexible impeller extends radially from the axis to an impeller radial distance; and
a rigid cutting implement extending radially from the axis to a distal end at a rigid cutting implement radial distance less than the impeller radial distance, wherein the distal end of the cutting implement is spaced apart from and does not contact the flexible impeller.

12. The impeller assembly of claim 11, wherein the flexible impeller comprises a plurality of flexible paddles.

13. The impeller assembly of claim 11, further comprising:
a first side mounting plate attached to a first end of the flexible impeller and a second side mounting plate attached to a second end of the flexible impeller;
wherein the first and second side mounting plates are attached to the driven shaft.

14. The impeller assembly of claim 11, wherein the cutting implement comprises a tine.

15. The impeller assembly of claim 14, wherein the tine includes a first body portion extending away from the axis in a first direction and a second body portion extending away from the axis in a second opposite direction.

16. The impeller assembly of claim 15, wherein the tine further includes a first angled portion extending at an angle from the first body portion at the distal end of the first body portion and a second angled portion extending at an angle from the second body portion at the distal end of the second body portion.

17. An impeller assembly for a snowthrower, comprising:

an impeller paddle configured for rotation about an axis and extending horizontally across substantially a complete width of the impeller assembly along the axis, wherein the impeller paddle extends radially from the axis to a paddle radial distance; and a tine extending radially from the axis to a distal end at a tine radial distance less than the paddle radial distance, wherein the distal end of the tine is spaced apart from and does not contact the impeller paddle.

18. The impeller assembly of claim 17, wherein the impeller paddle comprises a plurality of impeller paddles.

19. The impeller assembly of claim 17, further comprising:

a first side mounting plate attached to a first end of the impeller paddle and a second side mounting plate attached to a second end of the impeller paddle;

wherein the first and second side mounting plates are attached to the driven shaft.

20. The impeller assembly of claim 17, further comprising a plurality of cutting implements.

* * * * *